US011874031B2

(12) United States Patent
Saunders et al.

(10) Patent No.: US 11,874,031 B2
(45) Date of Patent: Jan. 16, 2024

(54) OIL CONTROL FOR CLIMATE-CONTROL SYSTEM

(71) Applicant: Copeland LP, Sidney, OH (US)

(72) Inventors: Michael A. Saunders, Sidney, OH (US); Natarajan Rajendran, Centerville, OH (US); Michael M. Perevozchikov, Tipp City, OH (US); Kirill M. Ignatiev, Sidney, OH (US)

(73) Assignee: Copeland LP, Sidney, OH (US)

( * ) Notice: Subject to any disclaimer, the term of this patent is extended or adjusted under 35 U.S.C. 154(b) by 284 days.

(21) Appl. No.: 16/719,347

(22) Filed: Dec. 18, 2019

(65) Prior Publication Data

US 2020/0200160 A1 Jun. 25, 2020

Related U.S. Application Data

(60) Provisional application No. 62/782,014, filed on Dec. 19, 2018.

(51) Int. Cl.
*F25B 49/02* (2006.01)
*F25B 1/10* (2006.01)
(Continued)

(52) U.S. Cl.
CPC ..... *F25B 1/10* (2013.01); *F04B 23/04* (2013.01); *F04B 39/023* (2013.01);
(Continued)

(58) Field of Classification Search
CPC .... F04B 39/0207; F04B 41/06; F25B 49/022; F04C 28/02; F04C 29/028
See application file for complete search history.

(56) References Cited

U.S. PATENT DOCUMENTS 6,082,132 A 7/2000 Numoto et al.
10,337,766 B2 7/2019 Takizawa
(Continued)

FOREIGN PATENT DOCUMENTS

CN 107806411 A 3/2018
EP 2487437 A1 8/2012
(Continued)

OTHER PUBLICATIONS

Takegami, Refrigerating Device, 2001, Full Document (Year: 2001).*
(Continued)

*Primary Examiner* — Nael N Babaa
(74) *Attorney, Agent, or Firm* — Harness, Dickey & Pierce, P.L.C.

(57) ABSTRACT

A system may include a first compressor, a second compressor, a first heat exchanger and a second heat exchanger. The first compressor has a first inlet and a first outlet. The second compressor is a sumpless compressor and has a second inlet and a second outlet. The second compressor provides working fluid discharged from the second outlet to the first compressor. The first heat exchanger is disposed upstream of the second compressor and provides working fluid to the second compressor. The second heat exchanger is disposed upstream of the first compressor and provides working fluid to the first compressor.

12 Claims, 3 Drawing Sheets

(51) Int. Cl.

| | |
|---|---|
| ***F04B 39/02*** | (2006.01) |
| ***F04D 25/16*** | (2006.01) |
| ***F04D 27/00*** | (2006.01) |
| ***F04D 29/063*** | (2006.01) |
| ***F25B 13/00*** | (2006.01) |
| ***F04C 28/02*** | (2006.01) |
| ***F04C 29/02*** | (2006.01) |
| ***F04C 18/02*** | (2006.01) |
| ***F04C 23/00*** | (2006.01) |
| ***F04B 41/06*** | (2006.01) |
| ***F04B 23/04*** | (2006.01) |

(52) U.S. Cl.

CPC ..... *F04B 39/0207* (2013.01); *F04B 41/06* (2013.01); *F04C 18/023* (2013.01); *F04C 18/0215* (2013.01); *F04C 23/008* (2013.01); *F04C 28/02* (2013.01); *F04C 29/02* (2013.01); *F04C 29/028* (2013.01); *F04D 25/16* (2013.01); *F04D 27/00* (2013.01); *F04D 29/063* (2013.01); *F25B 13/00* (2013.01); *F25B 49/022* (2013.01); *F04C 2270/24* (2013.01); *F25B 2400/0401* (2013.01); *F25B 2400/13* (2013.01)

(56) References Cited

U.S. PATENT DOCUMENTS

| | | | | |
|---|---|---|---|---|
| 2007/0245768 | A1 | 10/2007 | Sakae et al. | |
| 2008/0282725 | A1 | 11/2008 | Ishibashi et al. | |
| 2008/0282728 | A1 | 11/2008 | Takegami et al. | |
| 2008/0283133 | A1 | 11/2008 | Shaw | |
| 2010/0132382 | A1* | 6/2010 | Rini ..... | F25B 31/002 62/84 |
| 2014/0208785 | A1* | 7/2014 | Wallace ..... | F25B 49/02 62/115 |
| 2017/0284706 | A1 | 10/2017 | Ozu et al. | |
| 2018/0066656 | A1 | 3/2018 | Perevozchikov et al. | |
| 2018/0066657 | A1 | 3/2018 | Perevozchikov et al. | |
| 2018/0209696 | A1 | 7/2018 | Takizawa | |

FOREIGN PATENT DOCUMENTS

| | | | |
|---|---|---|---|
| JP | 2002357367 | A | * 12/2002 |
| JP | 2007093017 | A | 4/2007 |
| JP | 2010025446 | A | 2/2010 |
| JP | 6390796 | B2 | 9/2018 |

OTHER PUBLICATIONS

International Search Report regarding Application No. PCT/US2019/067645 dated Sep. 4, 2020.

Written Opinion of the ISA regarding Application No. PCT/US2019/067645 dated Sep. 4, 2020.

International Search Report & Written Opinion regarding Application No. PCT/US2019/067652 dated Apr. 21, 2020.

Second Office Action regarding Chinese Patent Application No. 201980089563.3, dated Oct. 17, 2022. Translation provided by Unitalen Attorneys at Law.

First Office Action regarding Chinese Patent Application No. 201980089564.8, dated Apr. 29, 2022. Translation provided by Unitalen Attorneys at Law.

Second Office Action regarding Chinese Patent Application No. 201980089564.8, dated Sep. 27, 2022. Translation provided by Unitalen Attorneys at Law.

Decision of Rejection regarding Chinese Patent Application No. 201980089563.3, dated Feb. 11, 2023. Translation provided by Unitalen Attorneys at Law.

First Office Action regarding Chinese Patent Application No. 2019800879563.3, dated Apr. 27, 2022. Translation provided by Unitalen Attorneys at Law.

* cited by examiner

OIL CONTROL FOR CLIMATE-CONTROL SYSTEM

CROSS-REFERENCE TO RELATED APPLICATIONS

This application claims the benefit of U.S. Provisional Application No. 62/782,014, filed on Dec. 19, 2018. The entire disclosure of the above application is incorporated herein by reference.

FIELD

The present disclosure relates to oil control for a climate-control system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices, and one or more compressors circulating a working fluid (e.g., refrigerant or carbon dioxide) through the fluid circuit. Efficient and reliable operation of the climate-control system is desirable to ensure that the climate-control system is capable of effectively and efficiently providing a cooling and/or heating effect on demand.

SUMMARY

This section provides a general summary of the disclosure, and is not a comprehensive disclosure of its full scope or all of its features.

In one form, the present disclosure presents a system that may include a first compressor, a second compressor, a first heat exchanger and a second heat exchanger. The first compressor has a first inlet and a first outlet. The second compressor is a sumpless compressor and has a second inlet and a second outlet. The second compressor provides working fluid discharged from the second outlet to the first inlet of the first compressor. The first heat exchanger is disposed upstream of the second compressor and provides working fluid to the second compressor. The second heat exchanger is disposed upstream of the first compressor and provides working fluid to the first compressor.

In some configurations of the system of the above paragraph, the second compressor is a horizontal compressor.

In some configurations of the system of any one or more of the above paragraphs, a bypass passageway extends from a suction line of the second compressor at a location between the first heat exchanger and the second compressor to a discharge line of the second compressor.

In some configurations of the system of any one or more of the above paragraphs, the first heat exchanger is a low-temperature evaporator and the second heat exchanger is a medium-temperature evaporator.

In some configurations of the system of any one or more of the above paragraphs, an oil separator is disposed along a discharge line of the first compressor. The oil separator selectively provides lubricant to the first compressor.

In some configurations of the system of any one or more of the above paragraphs, working fluid entering the second compressor includes lubricant entrained therein.

In some configurations of the system of any one or more of the above paragraphs, the second compressor and the first heat exchanger are disposed within a low-temperature display case and are adjacent to each other.

In some configurations of the system of any one or more of the above paragraphs, a condenser is disposed downstream of the first compressor and receives working fluid discharged from the first compressor. The first fluid passageway extends from a location downstream of the condenser to the first inlet of the first compressor. The first fluid passageway includes a first expansion device and the second heat exchanger. The second fluid passageway extends from a location downstream of the condenser to the second inlet of the second compressor. The second fluid passageway includes a second expansion device and the first heat exchanger. A first portion of working fluid exiting the condenser flows to the first fluid passageway and a second portion of working fluid exiting the condenser flows to the second fluid passageway. Working fluid discharged from the second compressor mixes with the working fluid exiting the second heat exchanger prior to entering into the first inlet of the first compressor.

In another form, the present disclosure may provide a system including a first compressor, a second compressor, a first evaporator and a second evaporator. The first compressor has a first inlet and a first outlet. The second compressor may be a horizontal sumpless compressor and has a second inlet and a second outlet. The second compressor provides working fluid discharged from the second outlet to the first inlet of the first compressor. The first evaporator is disposed upstream of the second compressor and provides working fluid to the second compressor. The second evaporator is disposed upstream of the first compressor and provides working fluid to the first compressor.

In some configurations of the system of the above paragraph, a bypass passageway extends from a suction line of the second compressor at a location between the first evaporator and the second compressor to a discharge line of the second compressor.

In some configurations of the system of any one or more of the above paragraphs, the first evaporator is a low-temperature evaporator and the second evaporator is a medium-temperature.

In some configurations of the system of any one or more of the above paragraphs, an oil separator is disposed along a discharge line of the first compressor. The oil separator selectively provides lubricant to the first compressor.

In some configurations of the system of any one or more of the above paragraphs, working fluid entering the second compressor includes lubricant entrained therein.

In some configurations of the system of any one or more of the above paragraphs, the second compressor and the first evaporator are disposed within a low-temperature display case and are adjacent to each other.

In some configurations of the system of any one or more of the above paragraphs, a condenser is disposed downstream of the first compressor and receives working fluid discharged from the first compressor. The first fluid passageway extends from a location downstream of the condenser to the first inlet of the first compressor. The first fluid passageway includes a first expansion device and the second evaporator. The second fluid passageway extends from a location downstream of the condenser to the second inlet of the second compressor. The second fluid passageway includes a second expansion device and the first evaporator. A first portion of working fluid exiting the condenser flows to the first fluid passageway and a second portion of working fluid exiting the condenser flows to the second fluid passageway. Working fluid discharged from the second compressor mixes with the working fluid exiting the second evaporator prior to entering into the first inlet of the first compressor.

In yet another form, the present disclosure may provide a system including a first compressor, a second compressor, a low-temperature evaporator, a medium-temperature evaporator, a condenser and an oil apparatus. The first compressor has a first inlet and a first outlet. The second compressor is a horizontal sumpless compressor and has a second inlet and a second outlet. The second compressor provides working fluid discharged from the second outlet to the first inlet of the first compressor. The low-temperature evaporator is disposed upstream of the second compressor and provides working fluid to the second compressor. The medium-temperature evaporator is disposed upstream of the first compressor and provides working fluid to the first compressor. The condenser is disposed downstream of the first compressor and receives working fluid discharged from the first compressor. A first fluid passageway extends from a location downstream of the condenser to the first inlet of the first compressor. The first fluid passageway includes a first valve, a first expansion device and the medium-temperature evaporator. A second fluid passageway extends from a location downstream of the condenser to the second inlet of the second compressor. The second fluid passageway includes a second valve, a second expansion device and the low-temperature evaporator. A first portion of working fluid exiting the condenser flows to the first fluid passageway and a second portion of working fluid exiting the condenser flows to the second fluid passageway. The oil apparatus is disposed downstream of the first compressor at a location between the first compressor and the condenser. The oil apparatus is configured to entrap a portion of lubricant entrained in working fluid passing through the oil apparatus. The oil apparatus is configured to selectively provide lubricant from the oil apparatus to the first compressor via an oil-management valve device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
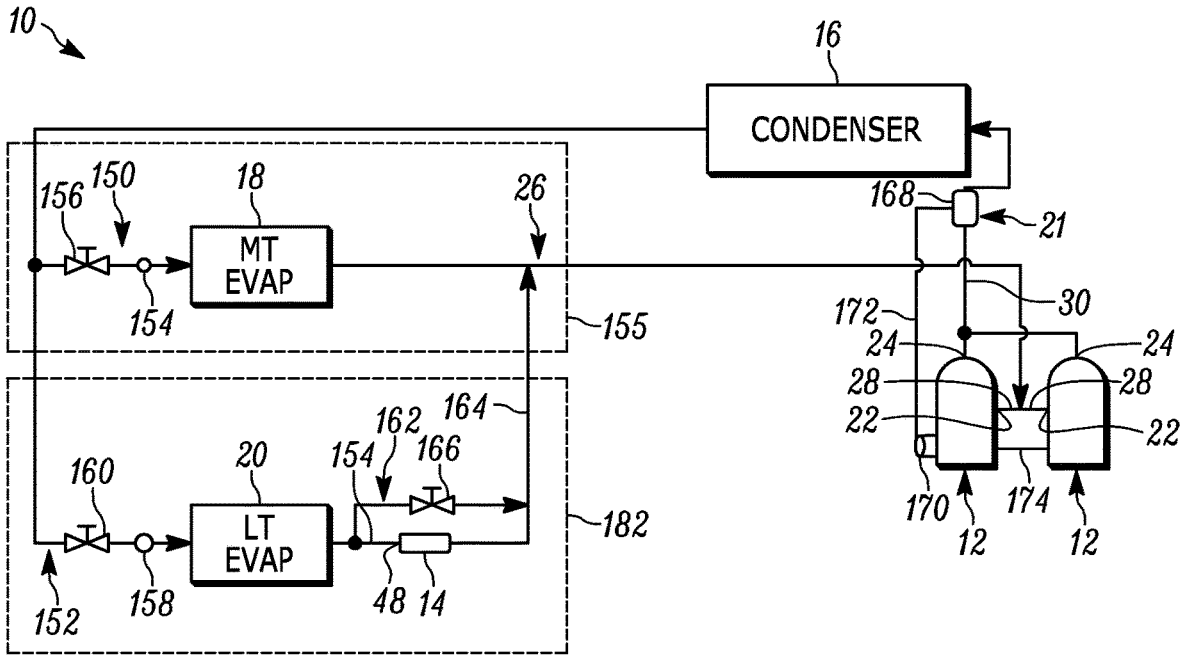
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include a fluid-circuit having one or more first compressors 12, one or more second compressors 14, a first heat exchanger 16 (an outdoor heat exchanger such as a condenser or gas cooler, for example), a second heat exchanger 18 (an indoor heat exchanger such as a medium-temperature evaporator, for example), a third heat exchanger 20 (an indoor heat exchanger such as a low-temperature evaporator, for example), an oil apparatus 21 and a control module 23. The one or more first compressors 12 and/or the one or more second compressors 14 may pump working fluid (e.g., refrigerant, carbon dioxide, etc.) through the circuit.

Each first compressor 12 may be a low-side compressor (i.e., a compressor in which the motor assembly is disposed within a suction-pressure chamber within the shell), for example, and may be any suitable type of compressor such as a scroll, rotary, reciprocating or screw compressor, for example. Each first compressor 12 may have an inlet 22 (e.g., a first inlet fitting) and an outlet 24 (e.g., an outlet fitting). The inlet 22 may provide fluid to a compression mechanism (not shown). A first fluid passageway 26 may extend from the second heat exchanger 18 to the inlets 22 of first compressors 12 via suction lines 28. In this manner, working fluid exiting the second heat exchanger 18 may flow into each first compressor 12 (via a respective inlet 22 and suction line 28) to be compressed by the compression mechanisms of the first compressors 12. After the working fluid is compressed by the compression mechanisms of the first compressors 12, the working fluid can be discharged from the first compressors 12 through the outlets 24 to a discharge line 30.

In some configurations, each first compressor 12 could be a high-side compressor (i.e., a compressor in which the motor assembly is disposed within a discharge-pressure chamber within the shell). In some configurations, each of the first compressors 12 may have different capacities than one another or than the one or more second compressors 14. In some configurations, one or more of the first compressors 12 and/or one or more of the second compressors 14 may include a fixed-speed, variable-speed motor. In some configurations, one or more of the first compressors 12 and/or one or more of the second compressors 14 may be other modulation types such as a pulse-width-modulation scroll compressor configured for scroll separation (e.g., a digital scroll compressor).

Figure 2:
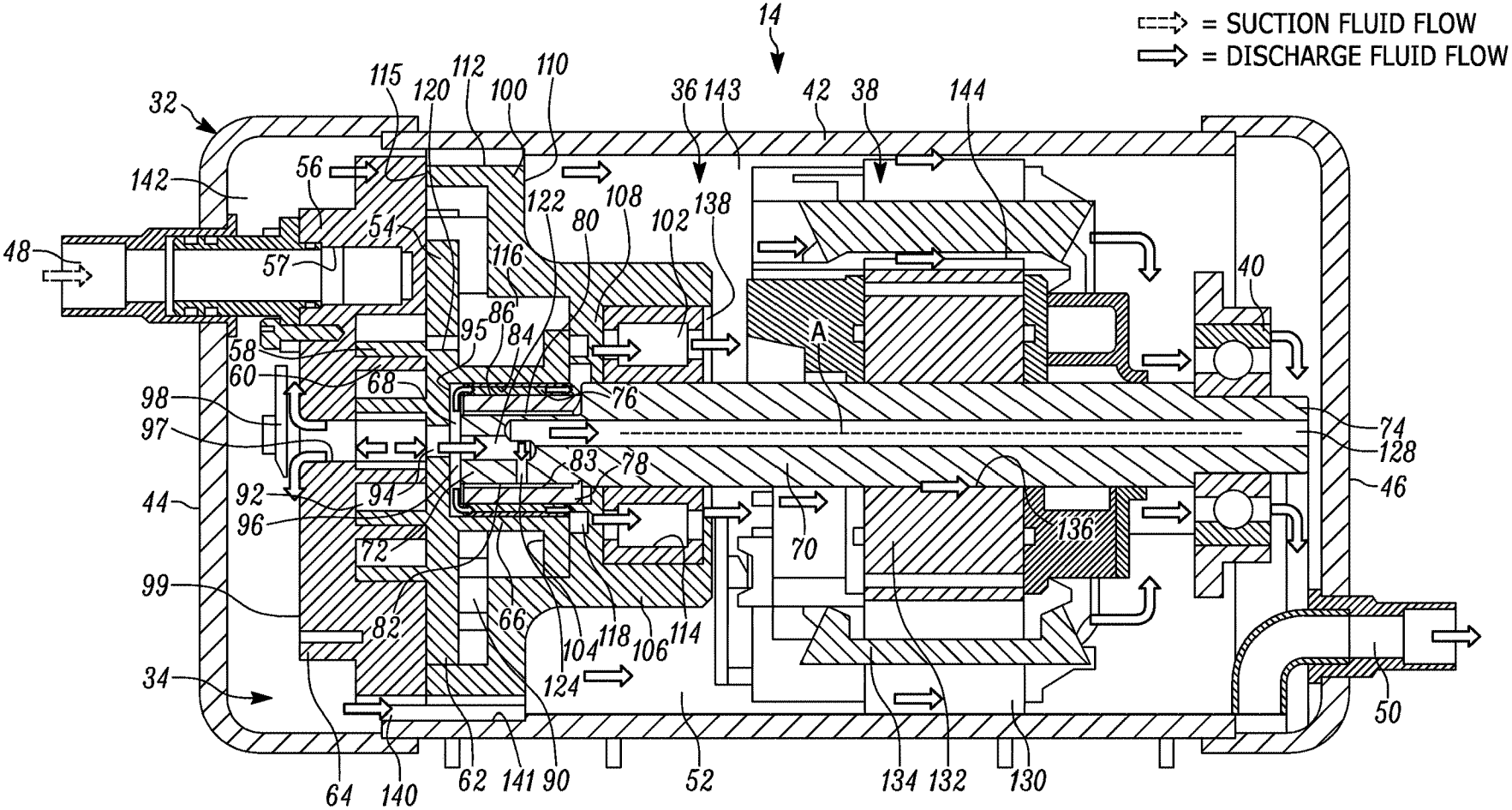
FIG. 2 is a cross-sectional view of a compressor of FIG. 1.

With reference to FIGS. 1 and 2, the second compressor 14 may be a horizontal compressor and may be adjacent to the third heat exchanger 20. The second compressor 14 may include a cylindrical shell 32, a compression mechanism 34, a bearing housing assembly 36, a motor assembly 38 and an end bearing 40. While the second compressor 14 shown in FIG. 2 is a high-side-compressor (i.e., where the motor assembly 38 is disposed in a discharge-pressure chamber of the shell 32), the principles of the present disclosure are suitable for incorporation in many different types of compressors, including low-side compressors (i.e., where the motor assembly 38 is disposed in a suction-pressure chamber of the shell 32).

The shell 32 houses the compression mechanism 34, the bearing housing assembly 36, the motor assembly 38, and the end bearing 40. The shell 32 includes a cylindrical main body 42, a first end cap 44 that fits over and sealing engages one end of the main body 42, and a second end cap 46 that fits over and sealing engages the other end of the main body 42. A suction tube or suction fitting 48 extends through the first end cap 44 of the shell 32 and receives a working fluid at a suction pressure from the third heat exchanger 20 of the climate control system 10. A discharge tube or discharge fitting 50 extends through the second end cap 46 of the shell 32 and discharges working fluid from the compression mechanism 34 to the first fluid passageway 26 where it mixes with working fluid exiting the second heat exchanger 18 before flowing into the first compressors 12.

The shell 32 defines a discharge chamber 52 (containing discharge-pressure fluid) in which the compression mechanism 34, the bearing housing assembly 36, the motor assembly 38, and the end bearing 40 are disposed. The second compressor 14 is depicted as a sumpless compressor—i.e., the second compressor 14 does not include a lubricant sump. Instead, lubricating fluid entrained in working fluid entering into the second compressor 14 and discharged from the compression mechanism 34 circulates throughout the shell 32 and lubricates various moving components of the second compressor 14.

The compression mechanism 34 includes an orbiting scroll member 54 and a non-orbiting scroll member 56. The non-orbiting scroll member 56 is fixed to the shell 32 (e.g., by press fit and/or staking) and/or to the bearing housing assembly 36 (e.g., by a plurality of fasteners). The non-orbiting scroll member 56 has a suction inlet 57 in fluid communication with the suction tube 48. The orbiting and non-orbiting scroll members 54, 56 include orbiting and non-orbiting spiral wraps (or vane) 58, 60, respectively, that meshingly engage each other and extend axially from orbiting and non-orbiting baseplates 62, 64, respectively. The orbiting scroll member 54 further includes a hub or tubular portion 66 that extends axially from the side of the orbiting baseplate 62 that is opposite of the side of the baseplate 62 from which the orbiting spiral wraps 58 extend. The tubular portion 66 defines a driveshaft cavity 68.

A driveshaft 70 rotates about a rotational axis A and has a first end 72 disposed in the driveshaft cavity 68 and a second end 74 opposite of the first end 72. The driveshaft 70 drivingly engages the orbiting scroll member 54, via a drive bearing 76 and an unloader bushing 78, to cause orbital movement of the orbiting scroll member 54 relative to the non-orbiting scroll member 56. The drive bearing 76 and the unloader bushing 78 are disposed in a drive bearing cavity 80, which is disposed between an outer radial surface 82 of the driveshaft 70 and an inner radial surface 84 of the tubular portion 66 of the orbiting scroll member 54. The drive bearing 76 and/or the unloader bushing 78 can be made from steel or other materials used in rolling element bearing designs. The drive bearing 76 can be press fit into the drive bearing cavity 80 of the orbiting scroll member 54. The unloader bushing 78 may be coupled to the driveshaft 70 in a manner that ensures that the unloader bushing 78 rotates or orbits with the driveshaft 70 while allowing some radial compliance between the driveshaft 70 and the unloader bushing 78. For example, the outer radial surface 82 of the driveshaft 70 may include a flat portion that engages a flat portion on an inner radial surface 83 of the unloader bushing 78 to prevent the unloader bushing 78 from rotating relative to the driveshaft 70. In addition, the unloader bushing 78 may include a spring (not shown) disposed between the outer radial surface 82 of the driveshaft 70 and the inner radial surface 83 of the unloader bushing 78, and the compliance of the spring may allow the orbiting scroll member 54 to move radially relative to the driveshaft 70.

The orbiting scroll member 54 may only move radially relative to the driveshaft 70 when a radial force applied to the orbiting scroll member 54 is greater than a biasing force of the spring.

The unloader bushing 78 is disposed about the driveshaft 70 adjacent to the first end 72 of the driveshaft 70 and is disposed between the outer radial surface 82 of the driveshaft 70 and an inner radial surface 86 of the drive bearing 76. The drive bearing 76 is disposed about the driveshaft 70 adjacent to the first end 72 of the driveshaft 70 and is disposed between the unloader bushing 78 and the inner radial surface 83 of the tubular portion 66 of the orbiting scroll member 54. Although radial gaps are shown between the driveshaft 70, the unloader bushing 78, the drive bearing 76, and the orbiting scroll member 54 to illustrate fluid flow between these components, these components may engage one another such that rotation of the driveshaft 70 is transferred to the orbiting scroll member 54.

An Oldham coupling 90 is keyed to the orbiting scroll member 54 and a stationary structure (e.g., the bearing housing assembly 36 or the non-orbiting scroll member 56) to prevent relative rotation between the orbiting and non-orbiting scroll members 54, 56 while allowing the orbiting scroll member 54 to move in an orbital path relative to the non-orbiting scroll member 56. Compression pockets 92 are formed between the orbiting and non-orbiting spiral wraps 58, 60 that decrease in size as they move from a radially outer position to a radially inner position, thereby compressing the working fluid therein from the suction pressure to the discharge pressure.

The baseplate 62 of the orbiting scroll member 54 defines a discharge passage 94 that extends axially through the baseplate 62 and discharges working fluid to the drive bearing cavity 80 after it has been compressed by the compression mechanism 34. The discharge passage 94 is located at or near the center of the orbiting scroll member 54 in the radial direction. The orbiting scroll member 54 has an axial end surface 95 that faces the driveshaft 70, and the first end 72 of the driveshaft 70 is spaced apart from the axial end surface 95 to provide a clearance gap 96. The clearance gap 96 is free of any seal that prevents fluid communication between the discharge passage 94 in the orbiting scroll member 54 and the drive bearing cavity 80. Thus, the discharge passage 94 is in fluid communication with the drive bearing cavity 80, which is disposed within the discharge chamber 52, and lubricating fluid entrained in the discharge fluid lubricates the drive bearing 76 and the unloader bushing 78.

The baseplate 64 of the non-orbiting scroll member 56 defines a discharge passage 97 that extends axially through the baseplate 64 and discharges working fluid to the discharge chamber 52 after it has been compressed by the compression mechanism 34. In addition, a discharge valve 98 regulates the flow of the discharge fluid through the discharge passage 97 in the non-orbiting scroll member 56. The discharge valve 98 may be a reed valve, a disc valve, or any other type of dynamic valve. The discharge passage 97 in the non-orbiting scroll member 56 may be at least partially aligned with the discharge passage 94 in the orbiting scroll member 54 in the radial direction. In various configurations, the discharge passage 97 and the discharge valve 98 may be omitted, which would enable reducing the size of the second compressor 14 by reducing the size of (or eliminating) the gap between an axial end surface 99 of the non-orbiting scroll member 56 and the first end cap 44 of the shell 32.

The bearing housing assembly 36 includes a main bearing housing 100 and a main bearing 102. The main bearing housing 100 is fixed relative to the shell 32 and defines a thrust bearing surface 104 for the orbiting scroll member 54. The main bearing housing 100 and the main bearing 102 radially support the driveshaft 70.

The main bearing housing 100 includes a first tubular portion 106, a first annular portion 108 that projects radially inward from the first tubular portion 106, a second annular portion 110 that projects radially outward from the first tubular portion 106, and a second tubular portion 112 that extends axially from the outer radial ends of the second annular portion 110. The first tubular portion 106 of the main bearing housing 100 defines a main bearing cavity 114 that receives the main bearing 102 and the driveshaft 70, and that is in fluid communication with the drive bearing cavity 80. Thus, discharge fluid flows from the drive bearing cavity 80 to the main bearing cavity 114, and lubricating fluid entrained in discharge gas lubricates the main bearing 102. The first annular portion 108 of the main bearing housing 100 defines the thrust bearing surface 104. The second tubular portion 112 of the main bearing housing 100 defines an antithrust surface 115 that abuts the non-orbiting scroll member 56.

The orbiting and non-orbiting scroll members 54, 56 and the main bearing housing 100 cooperate to define an intermediate chamber 116 that is disposed between the orbiting and non-orbiting scroll members 54, 56 and the main bearing housing 100. The Oldham coupling 90 is disposed in the intermediate chamber 116. An annular seal 118 is disposed at an interface between the orbiting scroll member 54 and the main bearing housing to prevent fluid communication between the intermediate chamber 96 and the discharge chamber 52.

The baseplate 62 of the orbiting scroll member 54 defines an intermediate chamber orifice 120 that extends axially through the baseplate 62 and is disposed radially between the discharge passage 94 and the suction inlet 57. The intermediate chamber orifice 120 places the compression pockets 92 in fluid communication with the intermediate chamber 116, thereby allowing working fluid at an intermediate pressure (i.e., a pressure greater than the suction pressure and less than the discharge pressure) to flow between the compression pockets 92 and the intermediate chamber 116. Lubricating fluid entrained in the intermediate fluid lubricates the Oldham coupling 90, the interface between the thrust bearing surface 104 of the main bearing housing 100 and the orbiting scroll member 54, and the interface between the antithrust surface 115 of the main bearing housing 100 and the non-orbiting scroll member 56.

The driveshaft 70 defines a first channel 122 extending axially through the first end 72 of the driveshaft 70 and a second channel 124 extending radially outward from the first channel 122 and through the outer radial surface 82 of the driveshaft 70. Discharge gas from the discharge passage 94 of the orbiting scroll member 54 and lubricating fluid entrained in the discharge gas may flow though the first and second channels 122, 124 and may lubricate the interface between the outer radial surface 82 of the driveshaft 70 and the inner radial surface 83 of the unloader bushing 78. The driveshaft 70 also defines a third channel 128 extending axially from the first channel 122 and through the second end 74 of the driveshaft 70. However, in various configurations, the driveshaft 70 may define the first and second channels 122, 124 without also defining the third channel 128.

The motor assembly 38 includes a stator 130 and a rotor 132. The motor assembly 38 can be a fixed-speed motor or a variable-speed motor. In some configurations, the motor assembly 38 may be an induction motor. In other configurations, the motor assembly 38 may be a switched reluctance motor. The stator 130 is disposed about the rotor 132 and includes a conductive member 134, such as copper wire, that generates a magnetic field, which causes the rotor 132 to rotate about the rotational axis A.

The rotor 132 is disposed about the stator 130 and is coupled to the driveshaft 70. In this regard, the rotor 132 may transmit rotational power to the driveshaft 70. The rotor 132 defines a central aperture 136 that receives the driveshaft 70 and is disposed about a portion of the driveshaft 70 located between the first and second ends 72, 74 of the driveshaft 70. The rotor 132 may be fixed relative to the driveshaft 70 by press fitting the driveshaft 70 within the central aperture 136. One or more additional or alternative means for fixing the driveshaft 70 to the rotor 132 could be employed, such as threaded engagement, adhesive bonding and/or fasteners, for example.

The first tubular portion 106 of the main bearing housing 100 has an open end 138 that allows discharge fluid to flow from the main bearing cavity 114 to the motor assembly 38. In addition, discharge fluid expelled through the discharge passage 97 in the non-orbiting scroll member 56 may flow radially outward and then axially past the compression mechanism 34 and the bearing housing assembly 36 to the motor assembly 38. In this regard, the non-orbiting scroll member 56 may define one or more fluid passages 140 extending axially through the non-orbiting scroll member 56, and the main bearing housing 100 may define one or more fluid passages 141 that extend axially through the main bearing housing 100 and that are radially aligned with the fluid passages 140. Thus, the discharge fluid expelled through the discharge passage 97 may flow through the fluid passages 140, 141 in the non-orbiting scroll member 56 and the main bearing housing 100, respectively, and to the motor assembly 38. In this regard, the discharge chamber 52 includes a first portion 142 disposed on a first side of the compression mechanism 34 and a second portion 143 disposed on a second side of the compression mechanism 34 opposite of the first side, and the fluid passages 140, 141 place the first portion 142 of the discharge chamber 52 in fluid communication with the second portion 143 of the discharge chamber 52.

Lubricating fluid entrained in the discharge fluid that flows to the motor assembly 38 may lubricate the interface between the shell 32 and the stator 130 and the interface between the rotor 132 and the driveshaft 70. In addition, the stator 130 may define one or more fluid passages 144 extending axially through the stator 130 and allowing the discharge fluid to flow through the stator 130 to the end bearing 40.

The end bearing 40 is disposed about the driveshaft 70 adjacent to the second end 74 of the driveshaft 70 and radially supports the driveshaft 70. Discharge fluid flows through the end bearing 40 after it passes through the motor assembly 38, and lubricating fluid entrained in the discharge fluid lubricates the end bearing 40. The discharge fluid then exits the second compressor 14 through the discharge tube 50. The discharge tube 50 may be located near the bottom of the second compressor 14 so that little to no lubricating fluid accumulates in the second compressor 14. This ensures that the amount of lubricating fluid flowing through the second compressor 14 is constant or fixed.

Referring back to FIG. 1, the first heat exchanger 16 may receive compressed working fluid from the first compressors 14 via the discharge line 30 and the oil apparatus 21, and may transfer heat from the compressed working fluid to ambient air that may be forced over the first heat exchanger 16 by a fan (not shown). In some configurations, the first heat exchanger 16 may transfer heat from the compressed working fluid to a stream of liquid such as water, for example. From the first heat exchanger 16, a first portion of the working fluid flows into a second fluid passageway 150 and a second portion the working fluid may flow through a third fluid passageway 152.

The second fluid passageway 150 may include a first expansion device 154 (e.g., an expansion valve, capillary tube or a mechanical valve) and the second heat exchanger 18 that is disposed within a medium-temperature display case 155 (e.g., refrigerator). The working fluid in the second fluid passageway 150 flows through the first expansion device 154 where its temperature and pressure is lowered. In the second heat exchanger 18, the working fluid may absorb heat from a first space to be cooled (e.g., an interior of a refrigerator, a refrigerated display case, or a cooler). From the second heat exchanger 18, the working fluid flows to the first fluid passageway 26 and into the first compressors 12 via the suction lines 28 and the inlets 22.

A first valve 156 may be disposed along the second fluid passageway 150 at a location upstream of the first expansion device 154 and may be movable between an open position in which working fluid is allowed to flow through the second fluid passageway 150 and a closed position in which working fluid is prevented from flowing through the second fluid passageway 150. It will be appreciated that the first valve 156 could be a solenoid valve, for example.

The third fluid passageway 152 may include a second expansion device 158 (e.g., an expansion valve, capillary tube, or a mechanical valve) and the third heat exchanger 20. The working fluid in the third fluid passageway 152 flows through the second expansion device 158 where its temperature and pressure is lowered. In the third heat exchanger 20, the working fluid may absorb heat from a second space to be cooled (e.g., freezer or a frozen food display case). In some configurations, the working fluid in the second heat exchanger 18 of the second fluid passageway 150 and the working fluid in the third heat exchanger 20 of the third fluid passageway 152 may absorb heat from the same space (e.g., the second heat exchanger 18 of the second fluid passageway 150 and the third heat exchanger 20 of the third fluid passageway 152 may operate at different times to switch the space between a freezer and a cooler, for example). From the third heat exchanger 20, the working fluid flows into the second compressor 14 via a suction line 154 and the inlet 48.

A second valve 160 may be disposed along the third fluid passageway 152 at a location upstream of the second expansion device 158 and may be movable between an open position in which working fluid is allowed to flow through the third fluid passageway 152 and a closed position in which working fluid is prevented from flowing through the third fluid passageway 152. It will be appreciated that the second valve 160 could be a solenoid valve, for example.

A bypass passageway 162 may extend from the suction line 154 of the second compressor 14 at a location between the third heat exchanger 20 and the second compressor 14 to a discharge line 164 of the second compressor 14. A bypass valve 166 may be disposed along the bypass passageway 162 and may be movable between open and closed positions. When in the open position, working fluid exiting the third heat exchanger 20 may flow through the bypass passageway 162 (i.e., bypassing the second compressor 14) and to the first fluid passageway 26. When in the closed position, working fluid exiting the third heat exchanger 20 may be prevented from flowing through the bypass passageway 162, thereby flowing into the second compressor 14. When the bypass valve 166 is in the closed position, the third heat exchanger 20 can operate as a low temperature evaporator. If the bypass valve 166 is in the open position and the second compressor 14 is turned OFF, the third heat exchanger 20 can operate as a medium temperature evaporator. Thus, a dual temperature operation of the third heat exchanger 20 may be achieved.

The oil apparatus 21 may include an oil separator 168, an oil-management valve device 170 and an oil passageway 172. The oil separator 168 is disposed along the discharge line 30 such that compressed working fluid discharged from the first compressors 12 passes through the oil separator 168 and at least a portion of the lubricant (e.g., oil) therein is entrapped in the oil separator 168. A lubricant or oil equalization conduit 174 may extend between the first compressors 12 and may be in fluid communication with internal cavities (not shown) of the first compressors 12. The oil-management valve device 170 is attached to the lubricant conduit 174 and is in fluid communication with the lubricant conduit 174. The device 170 monitors the lubricant (e.g., oil) levels within oil sumps of the internal cavities of the first compressors 12. The device 170 may communicate data to the control module 23 that the lubricant levels within the first compressors 12 are below, for example, a predetermined level. The device 170 may give off an alarm (via status lights) if the lubricant levels within the first compressors 12 are below, for example, a predetermined level. The device 170 may be movable between an open position in order to allow lubricant from the oil separator 168 to flow into the first compressors 12 and a closed position in order to prevent lubricant from the oil separator 168 from flowing into the first compressors 12. The device 170 may be movable between the open and closed positions by the control module 23 or by the lubricant level within the oil sumps of the first compressors 12 being below, for example, the predetermined levels.

Figure 3:
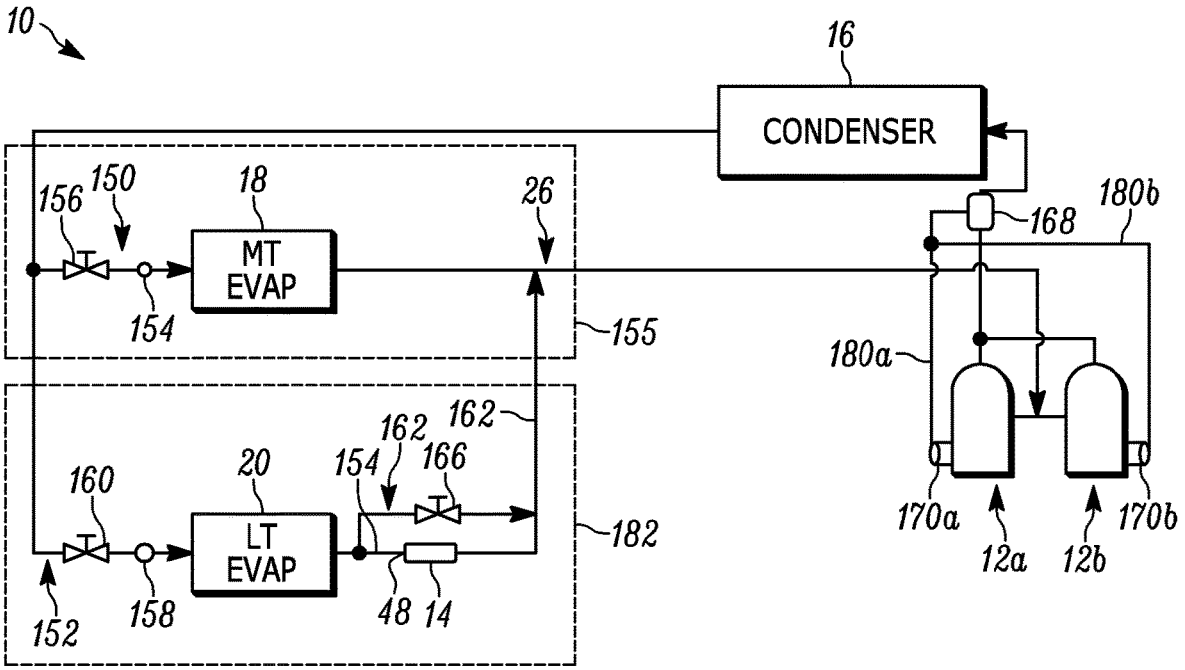
FIG. 3 is another schematic representation of a climate-control system.

In some configurations, as shown in FIG. 3, each first compressor 12*a*, 12*b* may include oil-management valve devices 170*a*, 170*b*, respectively. That is, the oil-management valve device 170*a* may be attached to the first compressor 12*a* and may be in fluid communication with an internal cavity of the first compressor 12*a*. The device 170*a* may also be in fluid communication with the oil separator 168 via an oil passageway 180*a*. Similarly, the oil-management valve device 170*b* may be attached to the first compressor 12*b* and may be in fluid communication with an internal cavity of the first compressor 12*b*. The device 170*b* may also be in fluid communication with the oil separator 168 via an oil passageway 180*b*. In this way, the lubricant levels within each compressor 12*a*, 12*b* may be monitored individually and filled separately, for example.

Figure 4:
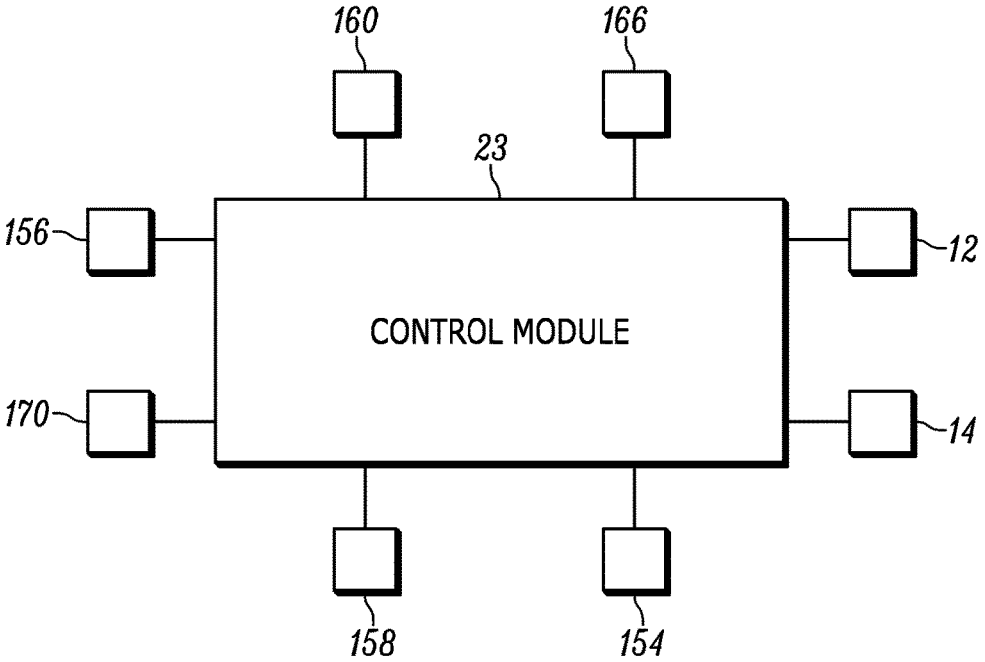
FIG. 4 is a block diagram illustrating communication between a control module and components of the climate-control system of FIG. 1.

As shown in FIG. 4, the control module 23 may be in communication with the first compressors 12, the second compressor 14, the expansion devices 154, 158, the device 170 and the valves 156, 160, 166, for example. The control module 23 can control operation of the first and second compressors 12, 14 and can open and close the valves 156, 160, 166 and the device 170 in order to provide efficient and reliable operation of the system 10.

In a Micro Booster climate-control system, compressed working fluid from the second compressor 14 (e.g., a low-temperature compressor) flows into the first compressors 12 (e.g., a medium-temperature compressor). The second compressor 14 being a sumpless compressor provides the benefit of relying on oil entrained in the working fluid circulating therein, which reduces the need for oil control components or oil management schemes for the second compressor 14. The second compressor 14 being a horizontal sumpless compressor provides the benefit of allowing the second compressor 14 to be positioned within a low-temperature display case 182 (e.g., freezer) adjacent to the third heat exchanger 20 which increases the efficiency of the climate-control system 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system comprising:

a first compressor having a first inlet and a first outlet;

a second compressor being a sumpless compressor and having a second inlet and a second outlet, the second compressor providing working fluid discharged from the second outlet to the first inlet of the first compressor;

a first heat exchanger disposed upstream of the second compressor and providing working fluid to the second compressor, the first heat exchanger and the second compressor being disposed within a first display case;

a second heat exchanger disposed upstream of the first compressor and providing working fluid to the first compressor, the second heat exchanger being a medium-temperature evaporator disposed within a second display case that is operated as a refrigerator;

a bypass passageway that extends from a suction line of the second compressor at a location between the first heat exchanger and the second compressor to a discharge line of the second compressor; and a bypass valve disposed along the bypass passageway and movable between an open position in which fluid is allowed to flow through the bypass passageway and a closed position in which fluid is restricted from flowing through the bypass passageway;

wherein:

the first heat exchanger is controlled to operate as a low-temperature evaporator and the first display case is controlled to operate as a freezer when the bypass valve receives communication controlling the bypass valve to move is to the closed position; and the first heat exchanger is controlled to operate as another medium-temperature evaporator and the first display case is controlled to operate as another refrigerator when the bypass valve receives communication controlling the bypass valve to move to the open position and the second compressor is controlled to turn off.

2. The system of claim 1, wherein the second compressor is a horizontal compressor.

3. The system of claim 1, wherein an oil separator is disposed along a discharge line of the first compressor, and wherein the oil separator selectively provides lubricant to the first compressor.

4. The system of claim 1, wherein working fluid entering the second compressor from the first heat exchanger includes lubricant entrained therein.

5. The system of claim 1, wherein the second compressor and the first heat exchanger are disposed within the first display case adjacent to each other.

6. The system of claim 1, further comprising:

a condenser disposed downstream of the first compressor and receiving working fluid discharged from the first compressor;

a first fluid passageway extending from a location downstream of the condenser to the first inlet of the first compressor, the first fluid passageway including a first expansion device and the second heat exchanger; and a second fluid passageway extending from a location downstream of the condenser to the second inlet of the second compressor, the second fluid passageway including a second expansion device and the first heat exchanger, a first portion of working fluid exiting the condenser flows to the first fluid passageway and a second portion of working fluid exiting the condenser flows to the second fluid passageway, wherein working fluid discharged from the second compressor mixes with the working fluid exiting the second heat exchanger in the first fluid passageway prior to entering into the first inlet of the first compressor.

7. A system comprising:

a first compressor having a first inlet and a first outlet;

a second compressor being a horizontal sumpless compressor and having a second inlet and a second outlet, the second compressor providing working fluid discharged from the second outlet to the first inlet of the first compressor;

a first evaporator disposed upstream of the second compressor and providing working fluid to the second compressor, the first evaporator and the second compressor being disposed within a first display case;

a second evaporator disposed upstream of the first compressor and providing working fluid to the first compressor, the second evaporator being a medium-temperature evaporator disposed within a second display case that is operated as a refrigerator;

a bypass passageway that extends from a suction line of the second compressor at a location between the first evaporator and the second compressor to a discharge line of the second compressor; and a bypass valve disposed along the bypass passageway and movable between an open position in which fluid is allowed to flow through the bypass passageway and a closed position in which fluid is restricted from flowing through the bypass passageway;

wherein:

the first evaporator is controlled to operate as a low-temperature evaporator and the first display case is controlled to operate, as a freezer when the bypass valve receives communication controlling the bypass valve to move is to the closed position; and the first evaporator is controlled to operate as another medium-temperature evaporator and the first display case is controlled to operate as another refrigerator when the bypass valve receives communication controlling the bypass valve to move to the open position and the second compressor is controlled to turn off.

8. The system of claim 7, wherein an oil separator is disposed along a discharge line of the first compressor, and wherein the oil separator selectively provides lubricant to the first compressor.

9. The system of claim 7, wherein working fluid entering the second compressor from the first evaporator includes lubricant entrained therein.

10. The system of claim 7, wherein the second compressor and the first evaporator are disposed within the first display case adjacent to each other.

11. The system of claim 7, further comprising:

a condenser disposed downstream of the first compressor and receiving working fluid discharged from the first compressor;

a first fluid passageway extending from a location downstream of the condenser to the first inlet of the first compressor, the first fluid passageway including a first expansion device and the second evaporator; and a second fluid passageway extending from a location downstream of the condenser to the second inlet of the second compressor, the second fluid passageway including a second expansion device and the first evaporator, a first portion of working fluid exiting the condenser flows to the first fluid passageway and a second portion of working fluid exiting the condenser flows to the second fluid passageway, wherein working fluid discharged from the second compressor mixes with the working fluid exiting the second evaporator in the first fluid passageway prior to entering into the first inlet of the first compressor.

12. A system comprising:

a first compressor having a first inlet and a first outlet, a second compressor being a horizontal sumpless compressor and having a second inlet and a second outlet, the second compressor providing working fluid discharged from the second outlet to the first inlet of the first compressor;

a dual-temperature evaporator disposed upstream of the second compressor and providing working fluid to the second compressor, the dual-temperature evaporator and the second compressor being disposed within a first display case;

a medium-temperature evaporator disposed upstream of the first compressor and providing working fluid to the first compressor, the medium-temperature evaporator being disposed within a second display case that is operated as a refrigerator;

a condenser disposed downstream of the first compressor and receiving working fluid discharged from the first compressor;

a first fluid passageway extending from a location downstream of the condenser to the first inlet of the first compressor, the first fluid passageway including a first valve, a first expansion device and the medium-temperature evaporator;

a second fluid passageway extending from a location downstream of the condenser to the second inlet of the second compressor, the second fluid passageway including a second valve, a second expansion device and the dual-temperature evaporator, a first portion of working fluid exiting the condenser flows to the first fluid passageway and a second portion of working fluid exiting the condenser flows to the second fluid passageway;

an oil apparatus disposed downstream of the first compressor at a location between the first compressor and the condenser, the oil apparatus configured to entrap a portion of lubricant entrained in working fluid passing through the oil apparatus, the oil apparatus configured to selectively provide lubricant from the oil apparatus to the first compressor via an oil-management valve device;

a bypass passageway that extends from a suction line of the second compressor at a location between the dual-temperature evaporator and the second compressor to a discharge line of the second compressor; and a bypass valve disposed along the bypass passageway and movable between an open position in which fluid is allowed to flow through the bypass passageway and a closed position in which fluid is restricted from flowing through the bypass passageway;

wherein:

the dual-temperature evaporator is controlled to operate as a low-temperature evaporator and the first display case is controlled to operate as a freezer when the bypass valve receives communication controlling the bypass valve to move to the closed position; and the dual-temperature evaporator is controlled to operate as another medium-temperature evaporator and the first display case is controlled to operate as another refrigerator when the bypass valve receives communication controlling the bypass valve to move to the open position and the second compressor is controlled to turn off.

* * * * *